US006305304B1

(12) United States Patent
Tanaka et al.

(10) Patent No.: US 6,305,304 B1
(45) Date of Patent: Oct. 23, 2001

(54) TWO-NEEDLE SEWING MACHINE

(75) Inventors: Makoto Tanaka; Noriyuki Hirose; Akira Maeda; Masahiko Tanaka; Kenji Kitada; Hiroyuki Kazehare, all of Tokyo (JP)

(73) Assignee: Juki Corporation, Tokyo (JP)

( * ) Notice: Subject to any disclaimer, the term of this patent is extended or adjusted under 35 U.S.C. 154(b) by 0 days.

(21) Appl. No.: 09/198,007

(22) Filed: Nov. 23, 1998

(30) Foreign Application Priority Data

Nov. 25, 1997 (JP) ..... 9-322758

(51) Int. Cl.[7] ..... D05B 1/08; D05B 69/30
(52) U.S. Cl. ..... 112/163; 112/168; 112/260
(58) Field of Search ..... 112/163, 168, 112/260, 228, 166

(56) References Cited

U.S. PATENT DOCUMENTS 611,768 * 10/1898 Brautigam ..... 112/163
785,168 * 3/1905 Hemleb ..... 112/163
4,043,283 * 8/1977 Jung ..... 112/163
4,641,591 * 2/1987 Draghicchio ..... 112/168 X
5,765,493 * 6/1998 Akahane et al. ..... 112/260 X

FOREIGN PATENT DOCUMENTS 5-81481 5/1993 (JP) .
7-140970 11/1995 (JP) .

* cited by examiner

*Primary Examiner*—Ismael Izaguirre
(74) *Attorney, Agent, or Firm*—Morgan & Finnegan, LLP

(57) ABSTRACT

The sewing machine comprises two hooks 27*a* and 27*b* which are respectively disposed in such a manner as to correspond to two needles 7 and 7 provided in the present sewing machine, hook gap adjusting device 33–35 respectively for changing the gap between the two hooks 27*a* and 27*b*, drive device 36 for driving the hook gap adjusting device 33–35, transmission device 37–41 respectively for transmitting the driving of the drive device 36 to the hook gap adjusting device 33–35, and control device 50 for controlling the driving of the drive device 36 to thereby control the above gap between the two hooks, whereby the sewing machine is able to move the hooks 27*a* and 27*b* easily only by driving the drive device.

17 Claims, 10 Drawing Sheets

(PRIOR ART)

TWO-NEEDLE SEWING MACHINE

BACKGROUND OF THE INVENTION

The present invention relates to a two-needle sewing machine which drives two needles simultaneously to thereby execute a sewing operation and, in particular, such two-needle sewing machine suitable for use as a belt loop sewing machine which sews a belt loop on a workpiece.

Conventionally, as an example of a two-needle sewing machine, there are proposed various types of belt loop sewing machines each of which is used to sew a plurality of belt loops to be inserted through a belt onto the waist portions of various workpieces (things to be sewn) such as jeans, pants, skirts and the like.

Here, FIGS. 7 and 8 show an example of the above-mentioned conventional belt loop sewing machines, which is disclosed, for example, in U.S. Pat. No. 5,588,384. In particular, the conventional belt loop sewing machine 1 comprises a sewing machine main body 2 serving as sewing means, as well as a belt loop forming device 3 and a belt loop supply device 4 which are respectively added to the sewing machine main body 2.

The sewing machine main body 2 is formed of, for example, a two-needle cycle sewing machine. In the interior portion of a sewing machine arm 6 that is located on the free end side (in FIG. 7, on the left side) thereof, there is disposed a needle rod drive mechanism 21 (FIG. 8) which is connected in such a manner as to be able to move a needle rod 8 up and down in linking with the upper shaft 22 (FIG. 8) of the sewing machine. To the lower end of the needle rod 8, there is fixed a needle stopper 8*a*, while two parallel arranged needles 7 and 7 are respectively fixed to the needle stopper 8*a*.

Also, downwardly of the sewing machine arm 6, there is disposed a long and narrow sewing machine bed 5 in such a manner that it extends in parallel to and is opposed to the sewing machine arm 6. On the upper surface of the sewing machine bed 5, there is disposed a needle plate 9 including needle holes 9*a* through which the needles 7 can be inserted. And, at the vertically moving positions of the needles 7, there are provided a pair of hold feet 10 in such a manner that the hold feet 10 can be pressure contacted with the upper surface of the needle plate 9 due to an elastically energizing force to thereby hold a cloth S between them. The hold feet 10 and 10 are supported by a known cloth hold device (not shown) in such a manner that it can be moved up and down with respect to the needle plate 9.

At the vertically moving positions of the needles 7 in the interior portion of the sewing machine bed 5, there are disposed a pair of known vertical hooks 27*a* and 27*b* which respectively include therein bobbins with lower threads wound therearound and cooperate together with the needles 7 in forming stitches. And, the vertical hooks 27*a* and 27*b* can be rotated in linking with lower shafts 26*a*, 26*b*, 26*c*, 26*d* (FIG. 8) which are respectively connected to the above-mentioned upper shaft.

In the belt loop sewing machine 1, generally, an operator works on the free end side of the sewing machine arm 6 and, for the sake of convenience, in FIG. 7, the free end side of the sewing machine arm 6 is expressed as FS, whereas the opposite side thereof is expressed as BS. In one side portion of the fee end side FS of the sewing machine main body 2, there are arranged the above-mentioned belt loop forming device and belt loop supply device 4.

The belt loop forming device 3 not only sends out a long loop material 12 for forming a belt loop along the longitudinal direction of the sewing machine main body 2 toward the FS side thereof by a supply source (not shown) disposed on the BS side of the sewing machine main body 2 but also cuts the loop material 12 into a given length to thereby form a belt loop.

That is, a loop send-out base 13 is disposed almost parallel to the sewing machine bed 5, and a disk-shaped cloth send gear 14, which serves as loop send-out means, with send teeth 15 formed on the outer peripheral surface thereof is disposed on the upper portion of the loop send-out base 13. In operation, the cloth send gear 14 is contacted with the upper surface of the loop material 12, which is shown by an imaginary line in FIG. 7, supplied onto the loop send-out base 13, and, due to the rotation of the cloth send gear 14 when it is driven by a loop send-out motor (not shown), the loop material 12 is sent out by a given amount toward a supply position which is set on the FS side.

Downstream of the loop send-out base 13 in the send direction, i.e. in the direction of an arrow B shown in FIG. 7, of the loop material 12, there is disposed cutting means 16 which is used to cut the loop material 12 into a given length. The cutting means 16 comprises a fixed blade which is fixedly mounted downwardly of the passage of the loop material 12, and a movable blade which is normally situated upwardly of the passage of the loop material 12 and can be moved down by cutting drive means (not shown) such as a cylinder or the like so as to be able cooperate together with the fixed blade in cutting the loop material 12.

Downstream of the cutting means 16 in the send direction, i.e. in the arrow B direction in FIG. 7, of the loop material 12, that is, at the supply position, there are disposed a pair of front and rear loop receiver members 17 which are used to support the cut formed belt loop having a given length, while the loop receiver members 17 are respectively formed in an L-like shape in which the leading end thereof is bent upwardly from below the belt loop. Also, between the two loop receiver members 17, there is interposed a guide rod 19 which is bent downwardly from one end side of the belt loop into an L-like shape. The guide rod 19 is used to hold the position of the loop material 12 sent to the supply position at a given position, while the guide rod 19 is also referred to as a loop move-up rod. That is, since the guide rod 19 moves up the side surface of the loop material 12 to a given position to thereby arrange the loop material 12 in order, when the two ends portions of the belt loop cut to a given length are bent by forks 20, the bent portions are prevented from shifting in position and can be overlapped together completely.

Now, the belt loop supply device 4 not only holds the two ends neighboring portions of the belt loop having a given length held at the supply position by the two loop receiver members 17, but also bends the two ends neighboring portions and then delivers the thus treated belt loop to a sewing position. The belt loop supply device 4 includes a pair of right and left forks 20 which are structured such that, after they hold between them the two ends neighboring portions of the belt loop having a given length held at the supply position by the two loop receiver members 17, they bend the two ends neighboring portions by 180 degrees in a downwardly folding manner, and, after then, they deliver the belt loop to the sewing position. Also, the respective leading end portions 20*a* of the two forks 20, as shown in FIG. 7, are normally situated at their respective retreat positions which are spaced to the right apart from the supply position, while the leading end portions 20*a* can be rotated as well as advanced and retreated by fork drive means such as an air cylinder or the like.

According to the conventional belt loop sewing machine having the above-mentioned structure, at first, the loop material 12 is sent out to the supply position from the upper surface of the loop send-out base due to the rotational movement of the cloth send gear 14 and is supported from below by the two loop receiver members 17 and, at the same time, the thus sent-out loop material 12 is moved up and is thereby arranged to one side by the guide rod 19. Next, the two forks 20 are advanced toward the BS direction from the retreat position to the supply position and the leading end portions 20*a* of the two forks 20 are inserted into the belt loop. After then, the base end portion side of the loop material 12 is cut to a given length by the cutting means 16, thereby forming a belt loop.

Then, the leading end portions 20*a* of the two forks 20 are rotated to thereby bend the two end portions of the belt loop by 180 degrees in a downwardly folding manner, and the forks 20 and 20 hold the thus treated belt loop between them and deliver the same from the supply position to the sewing position on the sewing S. After then, the cloth hold feet 10 are moved down to thereby hold the sewing S and belt loop on the needle plate 9. Further, after the forks 20 are retreated and are thereby pulled out from the belt loop, for example, the two side folded portions of the belt loop in the longitudinal direction thereof are sewn according to a given sewing pattern using the two needles 7 respectively supported by the needle rod drive means, so that the belt loop can be sewn at a given position of the sewing S.

By the way, preferably, the distance or gap between the two needles 7 supported by the needle rod 8 may be adjusted according to the length of the belt loop. For this purpose, there may be prepared a plurality of needle rods 8 which differ in the gap between the two needles 7 to be mounted thereon, and a desired one of the needle rods 8 may be selected and mounted on the needle rod drive means according to the length of the belt loop.

Or, the needles 7 may be structured such that they can be moved and adjusted in a direction at right angles to the cloth feed direction with respect to the needle stopper 8*a*.

When the gap between the two needles 7 is set in such a manner to be adjustable according to the length of the belt loop, the gap between the two hooks disposed opposed to the two needles 7 must also be formed in such a manner as to be adjustable.

For this reason, in the conventional belt loop sewing machine, as shown in FIG. 8, the other hook 27*b* is disposed in such a manner that it can be moved and adjusted in the axial direction thereof with respect to one hook 27*a*. That is, a crank mechanism 23 is provided in the base end portion of the upper shaft 22 and, by means of the crank mechanism 23, the rotation of the upper shaft 22 is transmitted to a lower base shaft 24 which is disposed within the sewing machine bed 5 and in parallel to the upper shaft 22. Also, a first lower shaft 26*a* and a second lower shaft 26*b* are respectively disposed within the sewing machine bed 5 in such a manner that they are spaced from each other in the vertical direction and they are arranged in parallel to the lower base shaft 24; and, the rotation of the lower base shaft 24 is transmitted to the first and second lower shafts 26*a* and 26*b* by means of a gear mechanism 25*a* composed of gears which are respectively provided on the shafts 24, 26*a* and 26*b*.

The first vertical hook 27*a* is fixed to the leading end of the first lower shaft 26*a*. On the other hand, a third lower shaft 26*c* is disposed on the same axis as the second lower shaft 26*b*, and the mutually opposed ends of the second lower shaft 26*b* and third lower shaft 26*c* are respectively fixed to a sleeve-shaped joint 28 by screws 29, while they are structured such that they can be integrally moved and adjusted in the axial direction thereof. Upwardly of the third lower shaft 26*c*, there is disposed a fourth lower shaft 26*d* which is structured such that the second vertical hook 27*b* is fixed to one end of the lower shaft 26*d* in the axial direction thereof, whereas the other end thereof in the axial direction is connected with the third lower shaft 26*c* through a gear mechanism 25*b*.

As described above, since the first and second vertical hooks 27*a* and 27*b* must be respectively set so that they correspond to the gap between the two needles 7 respectively supported by the needle stopper 8, in the above-mentioned structure, if the screws 29 are loosened to thereby advance or retreat the third lower shaft 26*c* in the axial direction with respect to the joint 28, then the projecting length of the third lower shaft 26*c* can be adjusted. Also, the fourth lower shaft 26*d* is disposed in such a manner that it can be moved and adjusted in the axial direction integrally with the third lower shaft 26*c* as the projecting length of the third lower shaft 26*c* is changed in the axial direction. In more particular, the third and fourth lower shafts 26*c* and 26*d* are supported by a casing 5A which is different from the sewing machine bed 5 and the present casing 5A is structured such that it can be moved in the axial direction thereof.

According to the above-mentioned structure, when the gap between the two needles 7 is adjusted according to the length of the belt loop, if the screws 29 of the joint 28 are loosened to thereby adjust the axial-direction positions of the third and fourth lower shafts 26*c* and 26*d* so that the second vertical hook 27*b* can be situated just below the position-changed needle 7, and after then, the screws 29 of the joint 28 are tightened to thereby fix the third lower shaft 26*c*, then the above-mentioned belt loop sewing operation can be executed.

However, in the above-structured conventional belt loop sewing machine, each time the gap between the two vertical hooks 27*a* and 27*b* is adjusted according to the adjustment of the gap between the two needles 7, the screws 29 must be loosened, which makes it troublesome to adjust the distance between the two vertical hooks 27*a* and 27*b*.

SUMMARY OF THE INVENTION

The present invention aims at eliminating the drawbacks found in the above-mentioned conventional belt loop sewing machine.

Accordingly, it is an object of the invention to provide a two-needle sewing machine such as a belt loop sewing machine and the like which is able to adjust the gap between two hooks easily and accurately.

In attaining the above object, according to a first aspect of the invention, there is provided a two-needle sewing machine comprising: two needles; needle rod drive means for moving the two needles in a vertical direction by needle rod drive means wherein a gap between the two needles can be changed; two hooks respectively disposed so as to correspond to the two needles; hook gap adjusting means for changing a gap between the two hooks; drive means for driving the hook gap adjusting means; transmission means for transmitting the driving of the drive means to the hook gap adjusting means; and control means for controlling the driving of the drive means to thereby control the hook gap.

In the above structure, while controlling the drive means by the control means, the drive means drives the hook gap adjusting means to thereby be able to adjust the hook gap automatically. That is, since it is not necessary to move the hook by hand, the hook gap can be adjusted easily.

According to a second aspect of the invention, there is provided a two-needle sewing machine comprising: an upper shaft having an axial direction; two needles arranged in parallel to each other in said axial direction of said upper shaft, wherein two needles are movable in a vertical direction to interlock with said upper shaft; two books, each positioned on locus of the vertical movement of said respective needle; a first lower shaft having a leading end to which one of said two hooks is fixed, wherein said first lower shaft is disposed in parallel to said upper shaft to rotate such that said first lower shaft interlocks with said upper shaft; a second lower shaft having a leading end to which the other of said two hooks is fixed, wherein said second lower shaft is disposed in parallel to said upper shaft to rotate such that said second lower shaft interlocks with said upper shaft; a link member linking between said first lower shaft and said second lower shaft to synchronize rotations of said first lower shaft and said second lower shaft; hook gap adjusting means for moving at least one of said first lower shaft and the second lower shaft in said axial direction to change a gap between said two hooks; driving means, being electrically driven, for driving said hook gap adjusting means; and control means for controlling said driving means such that said two hooks have a distance to each other corresponding to a distance between said two needles.

According to a third aspect of the invention, there is provided the two-needle sewing of the first aspect, wherein the control means includes fine adjustment means for moving at least one of the two hooks by a slight amount.

In this structure, a gap between the needle and the tip end of the hook can also be adjusted automatically and properly.

According to a fourth aspect of the invention, there is provided the two-needle sewing machine of the first aspect, wherein the two hooks are vertical hooks which are respectively located such that bobbins within the two hooks are disposed opposed to each other, and also wherein there is provided widening means for widening the gap between the two hooks by a given amount.

Because of such structure, the gap between the two hooks can be widened automatically by a given amount by the widening means, which can facilitate not only the maintenance of the present two-needle sewing machine such as the cleaning of the peripheries of the two hooks but also the replacement of the bobbins.

According to a fifth aspect of the invention, there is provided the two-needle sewing machine of the fourth aspect, wherein the widening means includes a bobbin replacing switch which is operative when replacing the bobbins, and, the operation of the bobbin replacing switch, the widening means widens the gap between the two hooks by a given amount.

Due to employment of this structure, when replacing the bobbins, simply by operating the bobbin replacing switch, the gap between the two hooks can be widened by a given amount, which can facilitate the replacement of the bobbins.

According to a sixth aspect of the invention, there is provided the two-needle sewing machine of the fourth aspect, wherein the widening means includes bobbin replacement timing detect means for detecting the timing for replacing the bobbins within the two hooks and, in accordance with the output of the bobbin replacement timing detect means, the widening means can widen the gap between the two hooks by a given amount.

In the above-structure, the gap between the two hooks can be widened automatically by a given amount in the bobbin replacing operation, which can reduce the burden of an operator in the bobbing replacing operation.

Due to provision of such return control means, even if the hook gap is widened by a given amount in the maintenance of the present two-needle sewing machine or in the bobbin replacing operation, the hook gap can be returned easily to its original state, thereby eliminating the need for readjustment of the hook gap.

According to an eighth aspect of the invention, there is provided the two-needle sewing machine of the first aspect, wherein the hook gap adjusting means is structured such that it can be driven by hand as well, and also wherein there is provided switch means which can switch the driving of the hook gap adjusting means by the drive means and the driving of the hook gap adjusting means by hand over to each other.

The employment of this structure makes it possible to adjust the hook gap by hand even when the drive means cannot be used.

According to a ninth aspect of the invention, there is provided the two-needle sewing machine described above, further including an original point sensor for detecting the original point position of the movable hook.

The employment of this structure makes it possible to position the movable hook with accuracy.

According to a tenth aspect of the invention, there is provided the two-needle sewing machine of the first aspect, wherein the two-needle sewing machine further includes supply means for supplying a belt loop having an arbitrary width to the sewing position of a workpiece and the two-needle sewing machine is a sewing machine which sews the belt loop to the workpiece.

The employment of this structure eliminates the need to adjust the hook space by band, which in turn avoids the need to secure a space for manual adjustment in the periphery of the hooks, thereby being able to reduce the limit to the installation of the belt loop supply means.

According to an eleventh aspect of the invention, there is provided the two-needle sewing machine of the tenth aspect, wherein the supply means is disposed on one side of a sewing machine bed, and the drive means is disposed on the other side or downwardly of the sewing machine bed.

DETAILED DESCRIPTION OF THE PREFERRED EMBODIMENTS

Now, FIGS. 1 to 6 respectively show an embodiment of a two-needle sewing machine according to the invention. In the present embodiment, in a sewing machine bed 5, there is disposed a movable casing 31 which stores therein a movable hook serving as a second vertical hook 27*b* (which will be discussed later) at a position opposed to a first vertical hook 27*a* facing to the outside from the end portion of the sewing machine bed 5.

Figure 2:
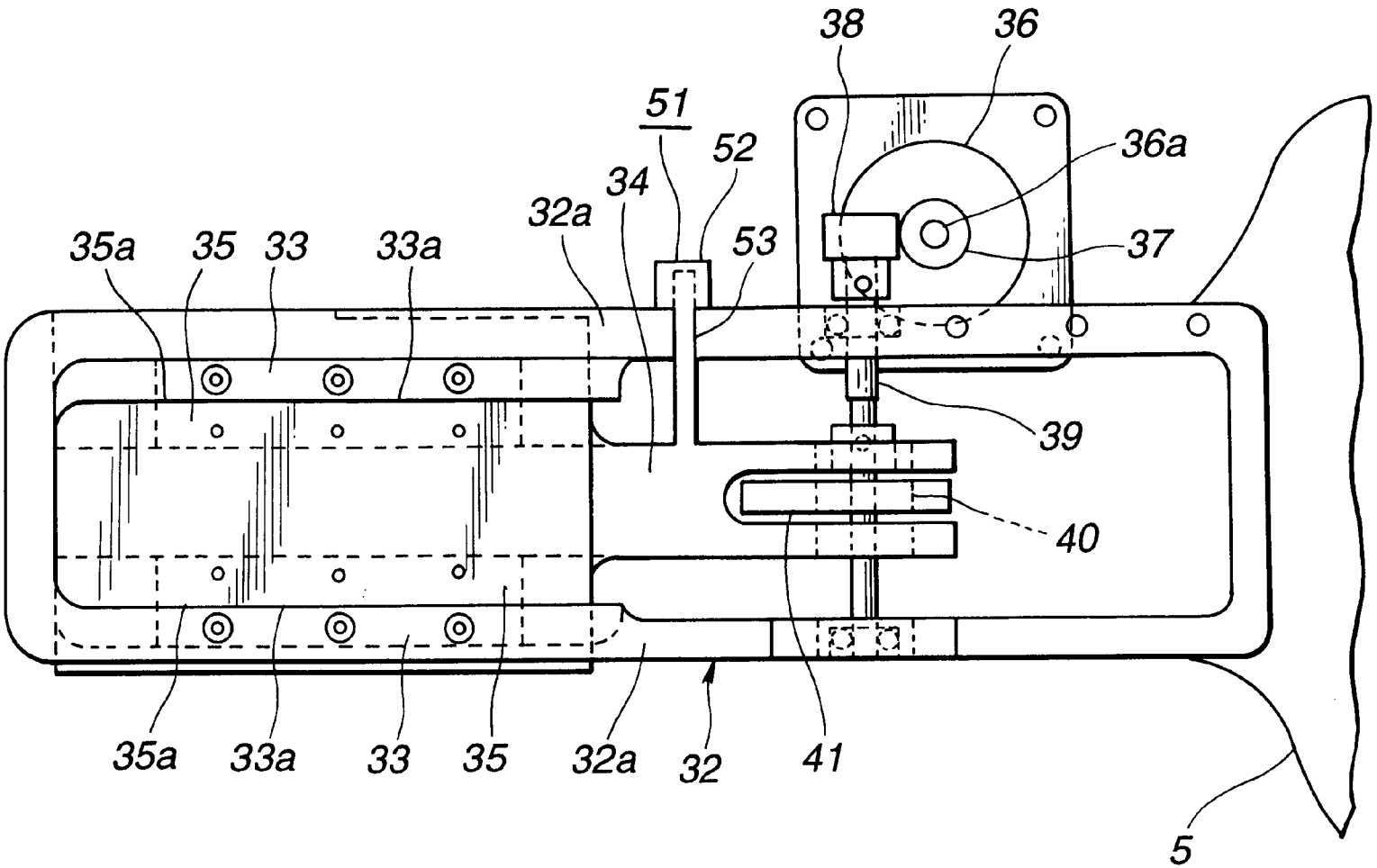
FIG. 2 is a bottom view of the main portions of the embodiment shown in FIG. 1.
Figure 3:
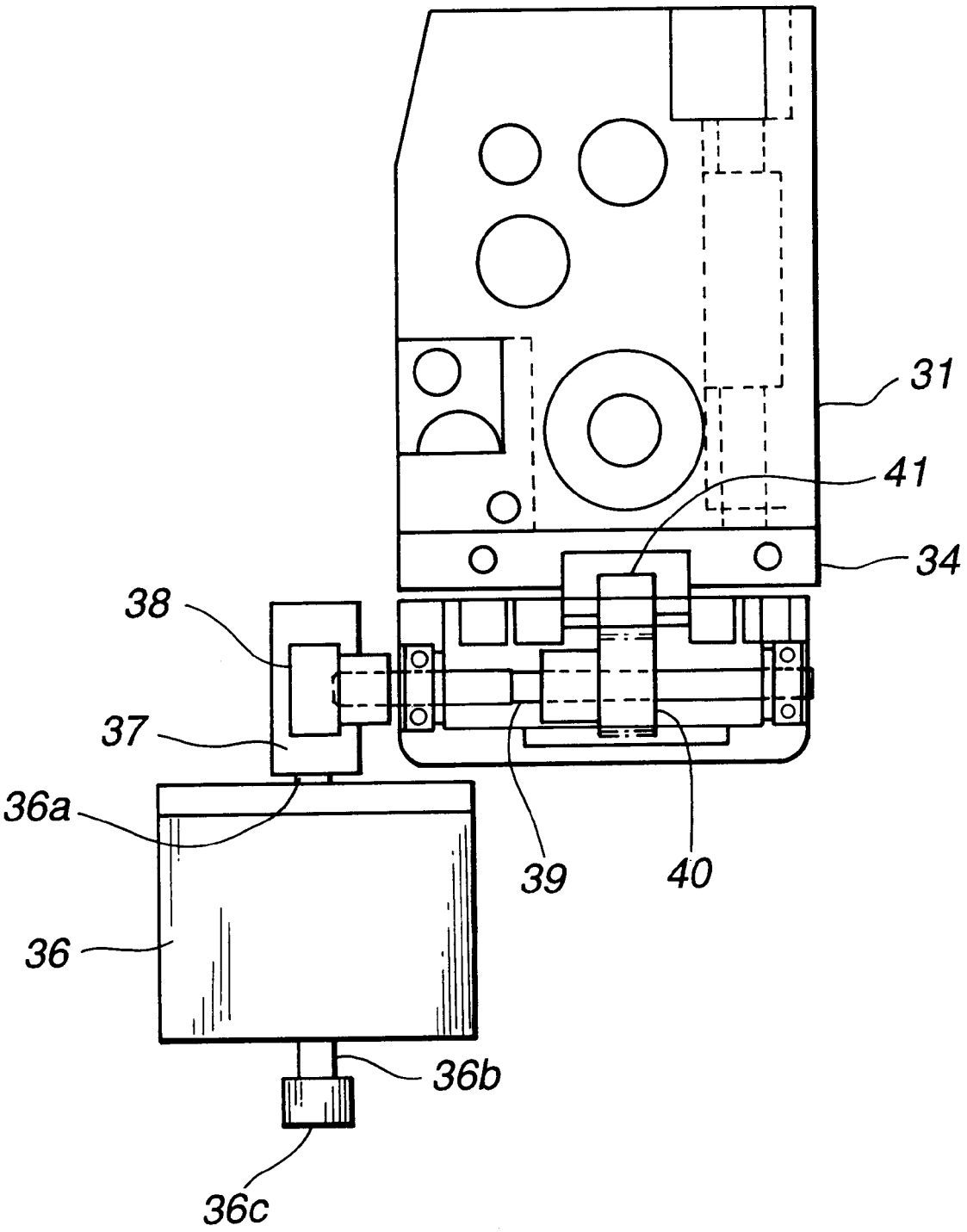
FIG. 3 is a side view of the main portions of the embodiment shown in FIG. 1.
Figure 9:
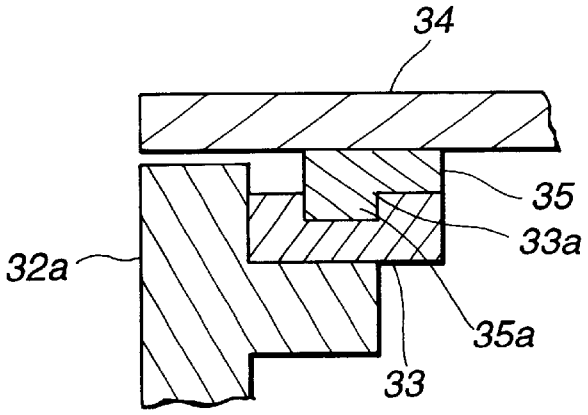
FIG. 9 is a longitudinal section view of the end portion of movement guide means employed in the above embodiment according to the invention.

That is, as shown in FIGS. 2 and 9, to the lower portion of the leading end of the sewing machine bed 5, there is fixed the base end portion of a hook support base 32 which extends in the horizontal direction; and, the hook support base 32 is formed in a rectangular shape in which at least the two side ends extending in the axial direction of a lower shaft are bent upward to thereby provide two side portions 32*a*. Inside the two side portions 32*a*, there are fixedly arranged a pair of plate-shaped guide members 33 and, on the upper surfaces of the guide members 33, there are formed linear-shaped guiding slits 33a which respectively extend in the moving direction of the vertical hook 27*b*.

The movable casing 31 is fixed to the upper surface of the a moving base 34 and is supported by the moving base 34 and, to the lower end face of the moving base 34, there are fixed a pair of members to be guided 35 and 35. The members to be guided 35 and 35 respectively include guide portions 35*a* and 35*a* which are projected downwardly and can be slidably engaged the guiding slits 33*a* and 33*a* respectively. The guide members 33, moving base 34, members to be guided 35 and the like cooperate together in forming hook gap adjusting means or movement guide means.

To the portion of the base end portion of the hook support base 32, that is located downwardly of the sewing machine bed 5, there is fixed a pulse motor 36 which is drive means for moving the movable casing 31 so as to change the hook distance, while a worm 37 is fitted with and mounted on an output shaft 36*a* which is situated at the upper end of the pulse motor 36. On the other hand, in the hook support base 32, there is rotatably supported a rotary shaft 39 which intersect at right angles to the moving direction of the movable casing 31 and extends in the horizontal direction below the hook support base 32, while a worm gear 38 meshingly engageable with the worm 37 is fixed to one end portion of the rotary shaft 39. The worm 37 and worm gear 38 cooperate together in forming a worm gear mechanism. Also, a pinion 40 is fitted with the central portion of the rotary shaft 39 in the axial direction thereof; and, on the other band, to the lower surface of the moving base 34, there is fixed a rack 41 which extends in the moving direction of the movable casing 31 and is meshingly engageable with the pinion 40. And, the worm 37, worm gear 38, rotary shaft 39, pinion 40 and rack 41 cooperate together in forming transmission means for transmitting the rotation of the pulse motor 36 to the hook gap adjusting means.

Therefore, in accordance with the forward or reversed rotation of the pulse motor 36, the movable casing 31 can be moved in an approaching direction or in a parting direction with respect to the sewing machine bed 5. By the way, in the present embodiment, the gap between the fixedly disposed first vertical hook 27*a* and the movably disposed second vertical hook 27*b* can be made to vary in the range of 40 mm to 70 mm.

Also, a lower shaft 36*b*, which is connected with the output shaft 36*a*, is projected from the lower end of the pulse motor 36, while a hand-operated knob 36*c* is provided on and projected from the lower shaft 36*b*. The hand-operated knob 36*c* can be operated by hand, as in a power failure or when the pulse motor 36 is out of order, in order to be able to change the gap between the first and second vertical hooks 27*a* and 27*b* even when the pulse motor 36 cannot be driven. That is, if a manual operation mode for adjustment of the hook distance is selected by operating switching means (which will be discussed later), then the supply of power to the pulse motor 36 is stopped, which puts the output shaft 36*a* of the pulse motor 36 into a state in which it can be rotated by hand. Since the pulse motor 36 is connected to the movable casing 31 of the movable vertical hook 27*b* by the transmission means including the worm gear 38 and the like, even if the pulse motor 36 is put into its rotatable state, there is no possibility that the movable casing 31 can be moved easily.

Figure 4:
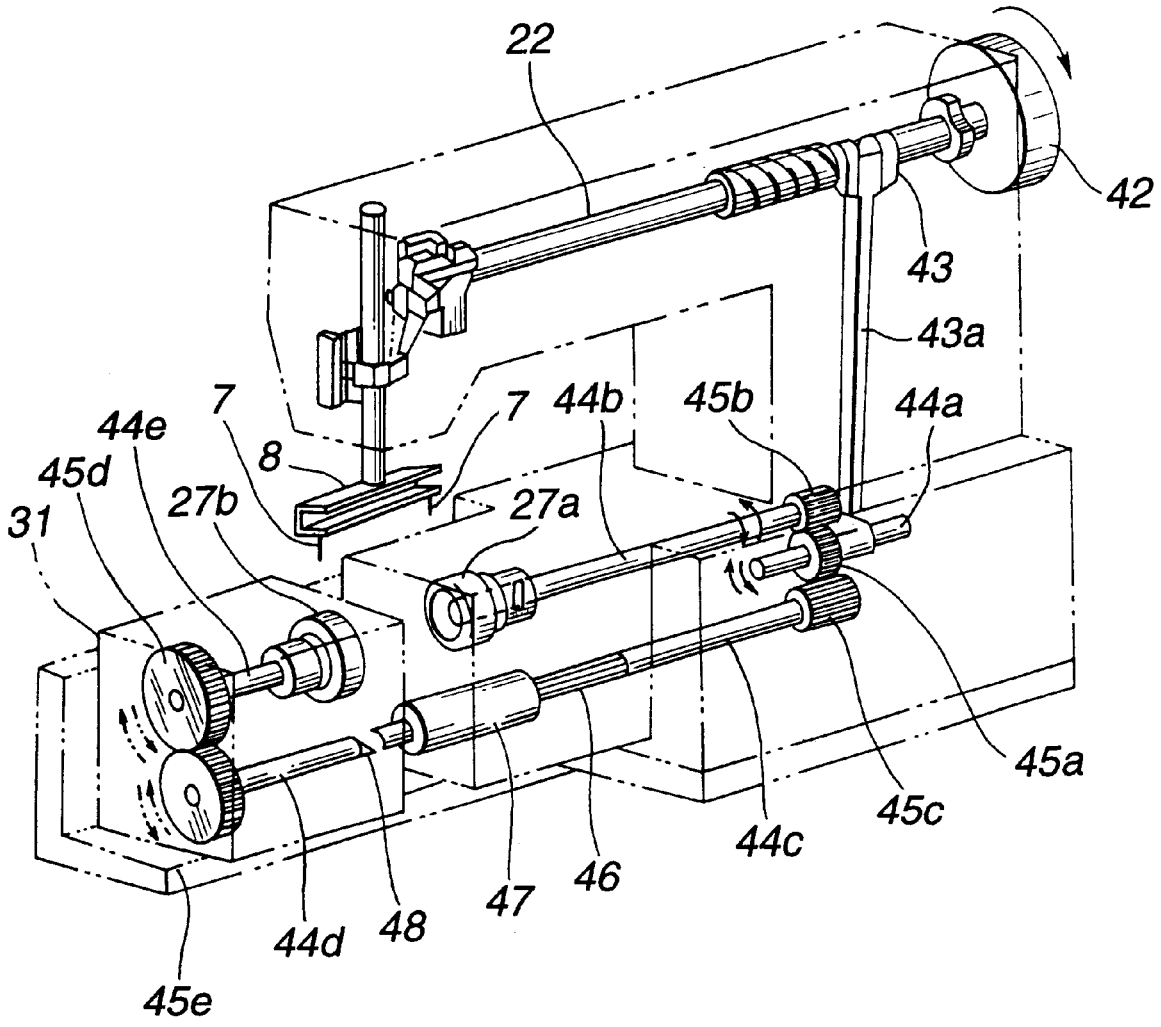
FIG. 4 is a perspective view of the embodiment shown in FIG. 1, showing a passage for transmission of a torque to second hook means.

Here, the transmission of drive forces not only to the second vertical hook 27*b* comprising a movable hook disposed within the movable casing 31 but also to the first vertical hook 27*a* which is fixedly disposed can be achieved in such a manner as shown in FIG. 4.

That is, in FIG. 4, in an upper shaft 22 to which the rotation of a sewing machine motor (not shown) is transmitted through a pulley 42, there is provided a crank mechanism 43, while the crank arm 43*a* of the crank mechanism 43 extends in the downward direction. The lower end of the crank arm 43*a* is eccentrically supported by a first lower shaft 44*a* and thus the rotation of the upper shaft 22 in the same direction can be changed by the crank mechanism 43 in such a manner as to be able to rotate the first lower shaft 44*a* alternatively in the forward and reversed directions by a given angle. Here, a second lower shaft 44*b* and a third lower shaft 44*c* are arranged in parallel to each other in such a manner that their respective one-sided ends are opposed to each other in the vertical direction with the first lower shaft 44*a* between them. The rotation of the first lower shaft 44*a* is transmitted to the second and third lower shafts 44*b* and 44*c* not only by a gear 45*a* fixed to the first lower shaft 44*a* but also by gears 45*b* and 45*c* which are respectively fixed to the second and third lower shafts 44*b* and 44*c*and are engaged with the gear 45*a*. And, the first vertical hook 27*a* is fixed to the leading end of the second lower shaft 44*b*.

On the other hand, in the leading end portion of the third lower shaft 44*c*, there is formed a spline 46. A fourth lower shaft 44*d* is disposed on the same axis as the third lower shaft 44*c*; to the end portion of the fourth lower shaft 44*d* that is opposed to the third lower shaft 44*c*, there is fixed a spline cylinder 47 which can be engaged with the spline 46 formed on the third lower shaft 44*c*; and, the fourth lower shaft 44*d* can be slided in the axial direction by the spline 46 and spline cylinder 47 with respect to the third lower shaft 44*c*. The fourth lower shaft 44*d* is divided into two half sections in the middle portion thereof in the axial direction thereof, while the two half sections are connected to each other by a universal joint 48; and, due to provision of the universal joint 48, even if the fourth and third lower shafts 44*d* and 44*c* are slightly inclined, they are able to move with respect to each other.

Therefore, the fourth lower shaft 44*d* is movable in the axial direction thereof in such a manner as to be able to change the total length in the axial direction that is a combination of its own length with the length of the third lower shaft 44*c*, while the torque of the third lower shaft 44*c* can be always transmitted to the fourth lower shaft 44*d* regardless of the position of the fourth lower shaft 44*d*.

And, upwardly of the fourth lower shaft 44*d*, a fifth lower shaft 44*e* is disposed on the same axis as the second lower shaft 44*b*, the second vertical hook 27*b* is fixed to one end of the fifth lower shaft 44*e* in such a manner as to be opposed to the first vertical hook 27*a*, and the rotation of the fourth lower shaft 44*d* can be transmitted to the fifth lower shaft 44*e* not only by a gear 45*d* fixed to the other end of the fifth lower shaft 44*e* in the axial direction thereof but also by a gear 45*e* fixed to the fourth lower shaft 44*d*.

The fourth and fifth lower shafts 44*d* and 44*e* are can be moved together while they are respectively being supported by the movable casing 31.

If the pulse motor 36 is driven and the movable casing 31 is thereby moved in the axial direction, then the fourth and fifth lower shafts 44*d* and 44*e* are moved in the axial direction integrally with the movable casing 31, with the result that the gap between the first and second vertical hooks 27*a* and 27*b* is changed.

Figure 5:
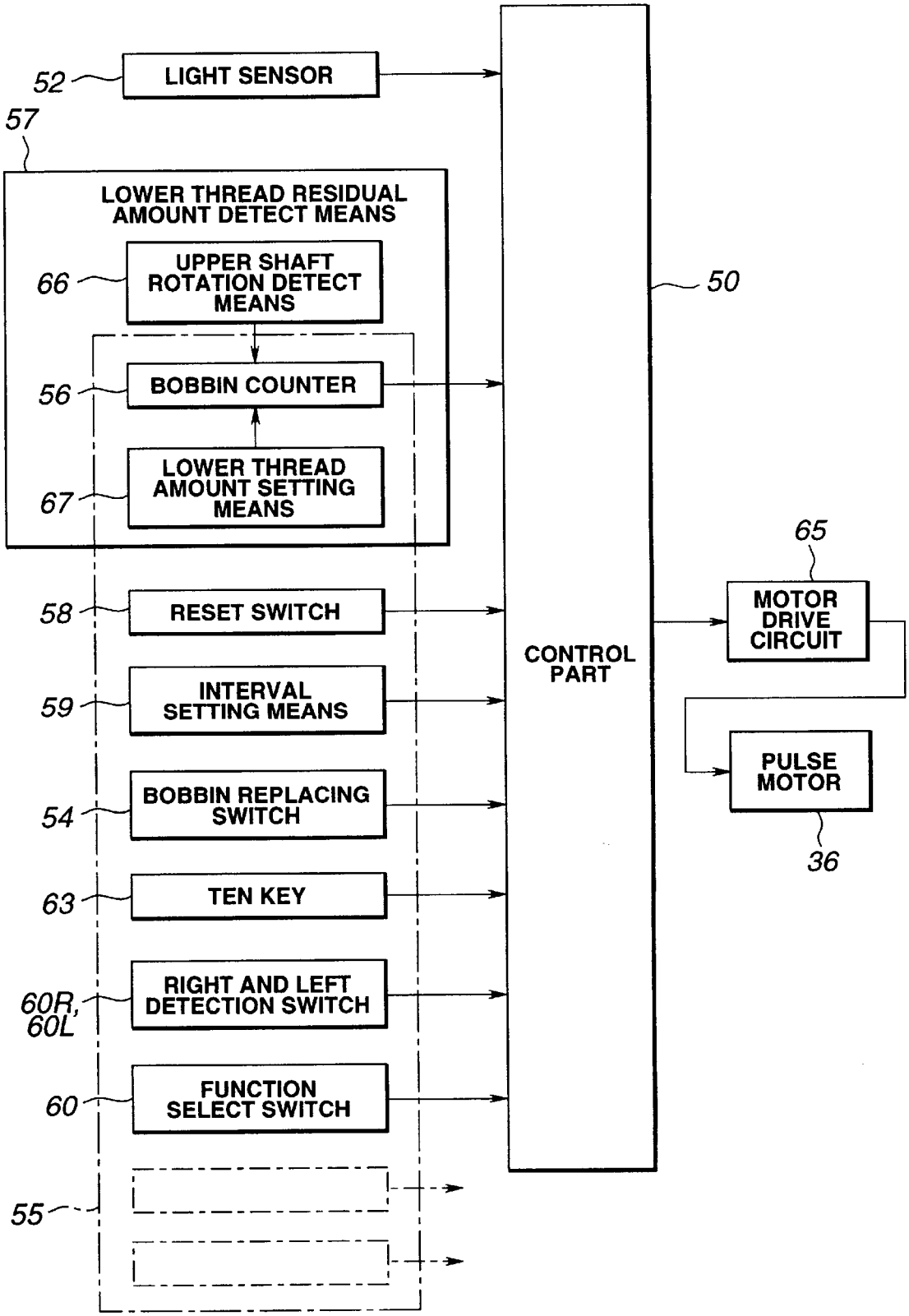
FIG. 5 is a block diagram of the main portions of the embodiment shown in FIG. 1, showing a control system employed in the embodiment.

In a block diagram shown in FIG. 5, the driving of the pulse motor 36 is controlled by the number of drive pulses given from a motor drive circuit 6. There is also disposed a control part 50 which is used to control the driving of the pulse motor 36. Further, there is disposed an original point sensor 51 which is used to detect the original point of the movement of the second vertical hook 27*b* in the axial direction thereof.

That is, the original point sensor 51, as shown in FIG. 2, is disposed in the neighboring portion of the pulse motor 36 and comprises a light sensor 52 of a transmission type, and an actuator 53 which is disposed in such a manner as to project laterally from the moving base 34. And, as the moving base 34 is moved, the actuator 53 shuts off the light of the light sensor 52, so that the light sensor 52 outputs an original point signal to the control part 50. By the way, the original point position of the second vertical hook 27*b* may be set, for example, when its gap with respect to the first vertical hook 27*a* is 40 mm.

Figure 6:
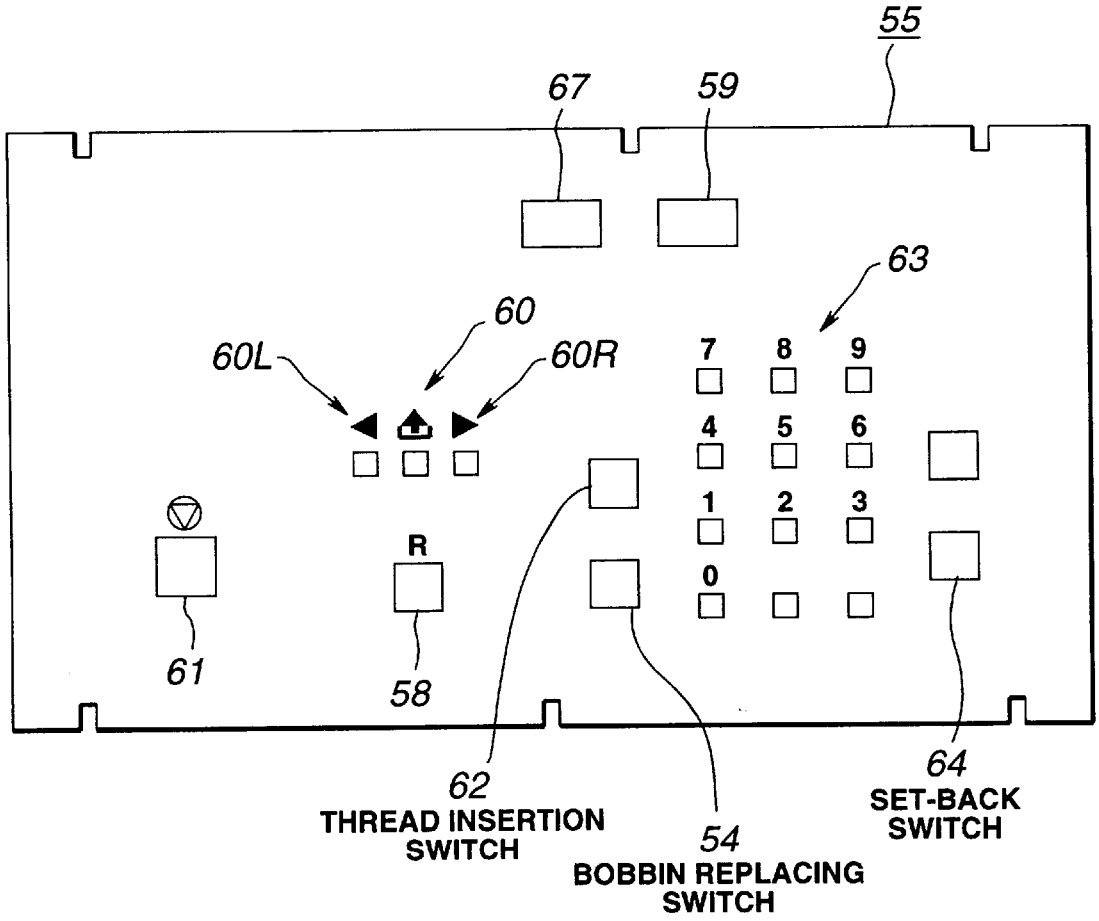
FIG. 6 is a front view of an operation panel employed in the embodiment shown in FIG. 1.

Now, on a table (not shown) on which the sewing machine is placed, there is disposed such an operation panel 55 as shown in FIG. 6 and, on the operation panel 55, there are disposed a bobbin replacing switch 54, a reset switch 58, a gap setting switch 59 and the like.

When the thread of a bobbin arranged in the vertical hook 27*a* or 27*b* is left little, or when it is necessary to change the color and kind of the bobbin thread, that is, when it is necessary to replace the bobbin within the hook with a new one, the bobbin replacing switch 54 is operated. In particular, if the bobbin replacing switch 54 is operated and a replacing signal is thereby generated, then the control part 50 actuates a motor drive circuit 65 to thereby drive the pulse motor 36, so that the gap between the first and second vertical hooks 27*a* and 27*b* can be set as a gap which can facilitate the removal of the bobbin from one hook, for example, the gap may be 100 mm.

If the reset switch 58 is operated, then a reset signal is generated. In accordance with the reset signal, the control part 50 actuates the motor drive circuit 65 to thereby drive the pulse motor 36, so that the gap between the first and second vertical hooks 27*a* and 27*b* can be set as a previously set gap.

The above-mentioned set gap corresponds to the gap between the needles 7 of the sewing machine, and the input value (gap length) of a ten key 63, which is obtained after the gap setting switch 59 provided on the panel 55 is operated, is previously stored in a storage portion RAM (not shown) included in the control part 50. That is, if the reset switch 58 is operated, then the input value stored in the storage portion of the control part 50 is read out and output therefrom.

The input value of the ten key 63, which is obtained after lower thread winding amount setting means provided on the operation panel 55 is operated, is previously set in a bobbin counter 56 which is provided within the operation panel 55. The present input value is set by an operator according to the amount of winding of the lower thread on the bobbin and sewing conditions. Or, alternatively, the operator may input the lower thread winding amount and sewing conditions, and the set value may be found and set automatically by operating the above input parameters. The bobbin counter 56 counts the output of upper shaft rotation detect means 66 which generates one pulse each time the sewing machine upper shaft is rotated once. And, if the count of the bobbin counter 56 coincides with the above-mentioned set value, then a detect signal is generated. On receiving the detect signal, the control part 50 actuates the motor drive circuit 65 to thereby drive the pulse motor 36, so that the gap between the first and second vertical hooks 27*a* and 27*b* can be set as a gap which can facilitate the removal of the bobbin from one hook, for example, the gap may be 100 mm.

On the operation panel 55, besides the above-mentioned switches, there are disposed various switches: that is, a function select switch 60, a right direction switch 60R, a left direction switch 60L, a stop switch 61 which is used to instruct the stop of the operation of the belt loop sewing machine, a thread insertion switch 62, a set-back switch 64 which is used to instruct the re-try of the supply of the belt loop, and the like.

In particular, the function select switch 60 is used to select one of an automatic operation mode in which the adjustment of the hook gap is made by driving the pulse motor 36, a manual operation mode for adjusting the hook gap by operating the knob 36*c* by hand, a setting mode for setting various sewing conditions and other parameters.

In the automatic operation mode, if the right direction switch 60R or left direction switch 60L is operated, then the control part 50 actuates the motor drive circuit 65 to thereby control the pulse motor 36 in such a manner that the second vertical hook 27*b* is moved in the right or left direction by a given amount, for example, by 0.1 mm each time the right direction switch 60R or left direction switch 60L is operated once. Due to this, the fine adjustment of the hook gap can be achieved.

By the way, in the above-mentioned case, the unit gap of the fine adjustment is 0.1 mm. However, in more particular, the fine adjustment unit gap may be determined in accordance with the resolving power of the pulse motor 36, the resolving power of the position adjustment of the needle, or the like.

Also, the control part 50 includes a timer which is used to measure a period or time for which the two switches 60R and 60L respectively having arrow designations are being pressed down. In particular, if the pressing time of the two arrow-designated switches 60R and 60L passes a given time (0.7 Sec.), then the second vertical hook 27*b* is moved continuously at a given speed. And, if the present pressing time further passes the given time (0.7 Sec.), that is, if the time of 1.4 Sec. has passed since the start of pressing the switches, then the moving speed of the second vertical hook is increased.

Figure 1:
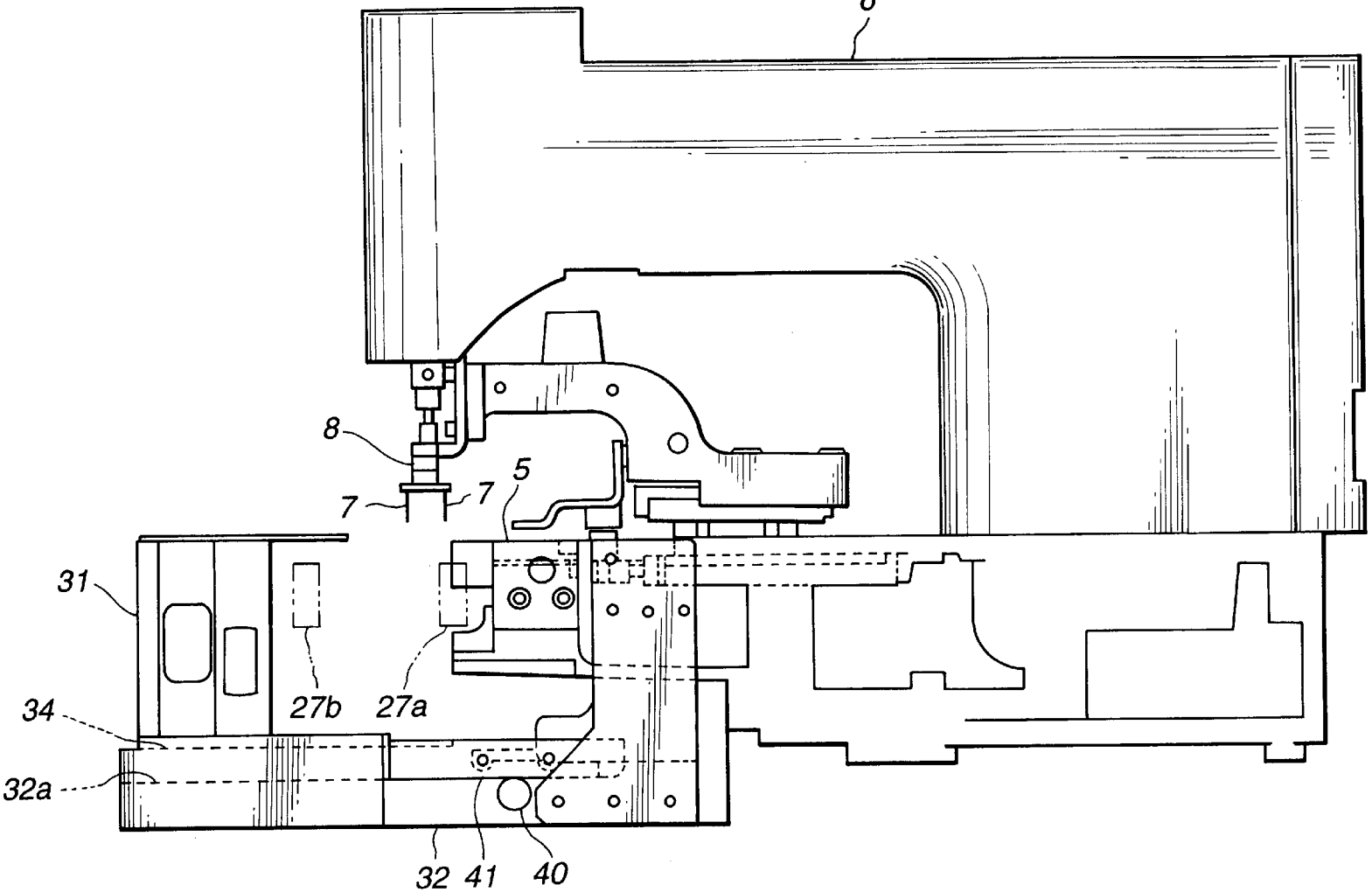
FIG. 1 is a front view of an embodiment of a belt loop sewing machine according to the invention.
Figure 7:
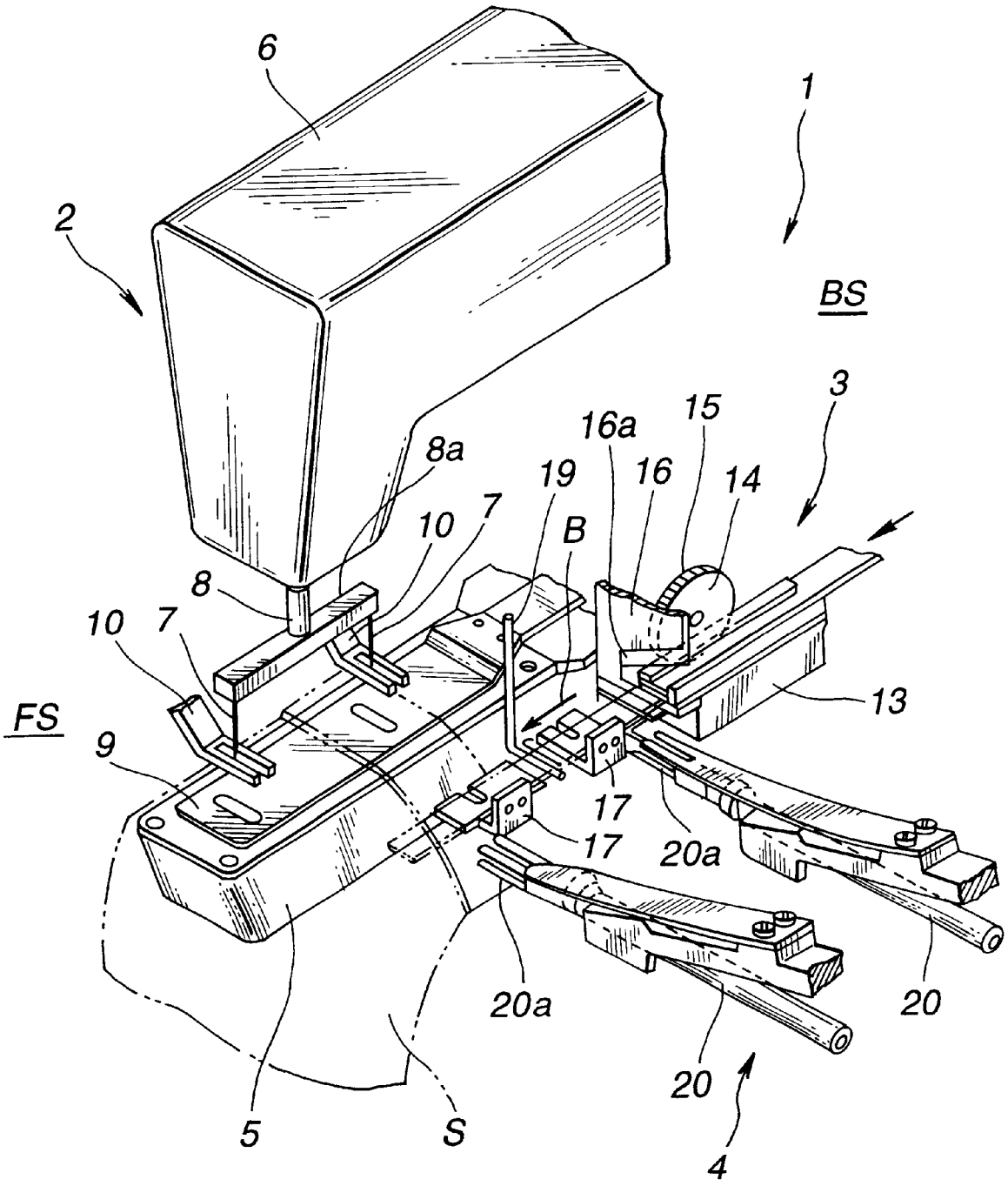
FIG. 7 is a perspective view of the main portions of a conventional belt loop sewing machine.
Figure 8:
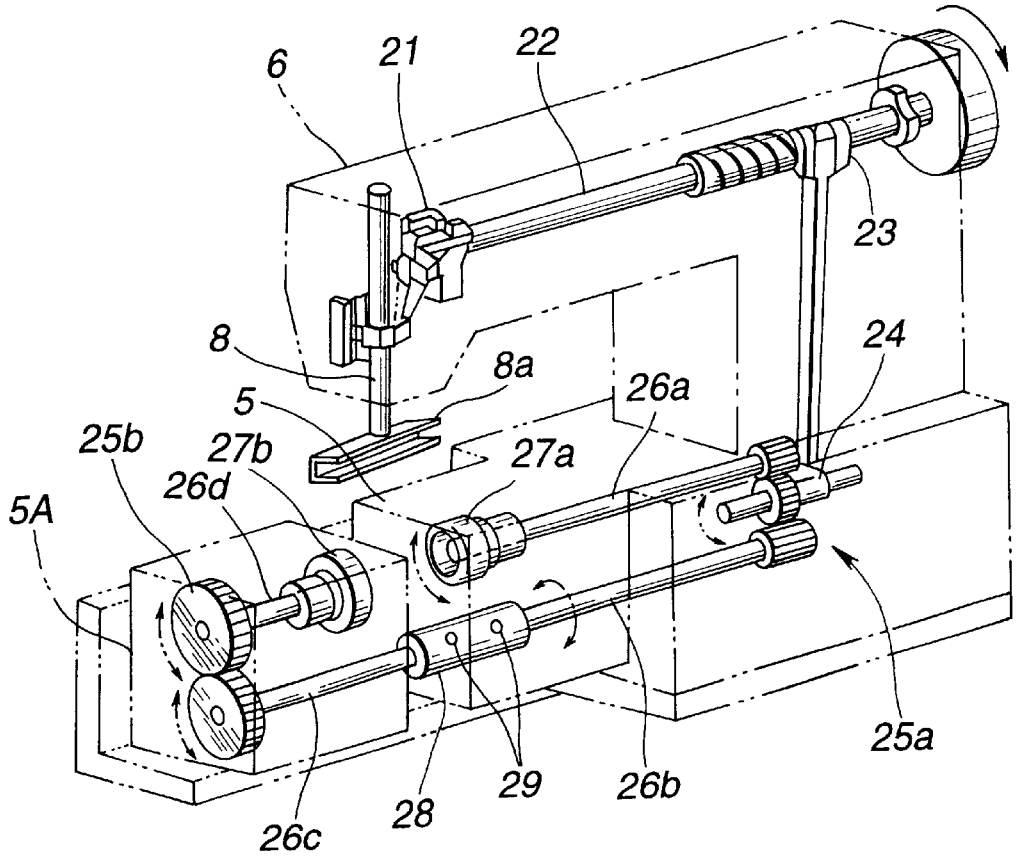
FIG.8 (PRIOR ART)
FIG. 8 is a perspective view of the conventional belt loop sewing machine showing a passage for transmission of a torque to movable hook means employed in the conventional sewing machine.

Further, the belt loop supply means, which is not shown in FIG. 1, as shown in FIG. 7, is disposed on one side of the sewing machine bed 5, that is, on this side thereof; and, the pulse motor 36 is disposed on the other side of the sewing machine bed 5. This makes it possible to secure not only a sufficient operation space for setting the main section of the sewing onto the sewing machine bed 5 but also a sufficient setting space for setting the belt loop supply means. By the way, alternatively, the pulse motor 36 may also be disposed downwardly of the sewing machine bed 5.

Figure 10:
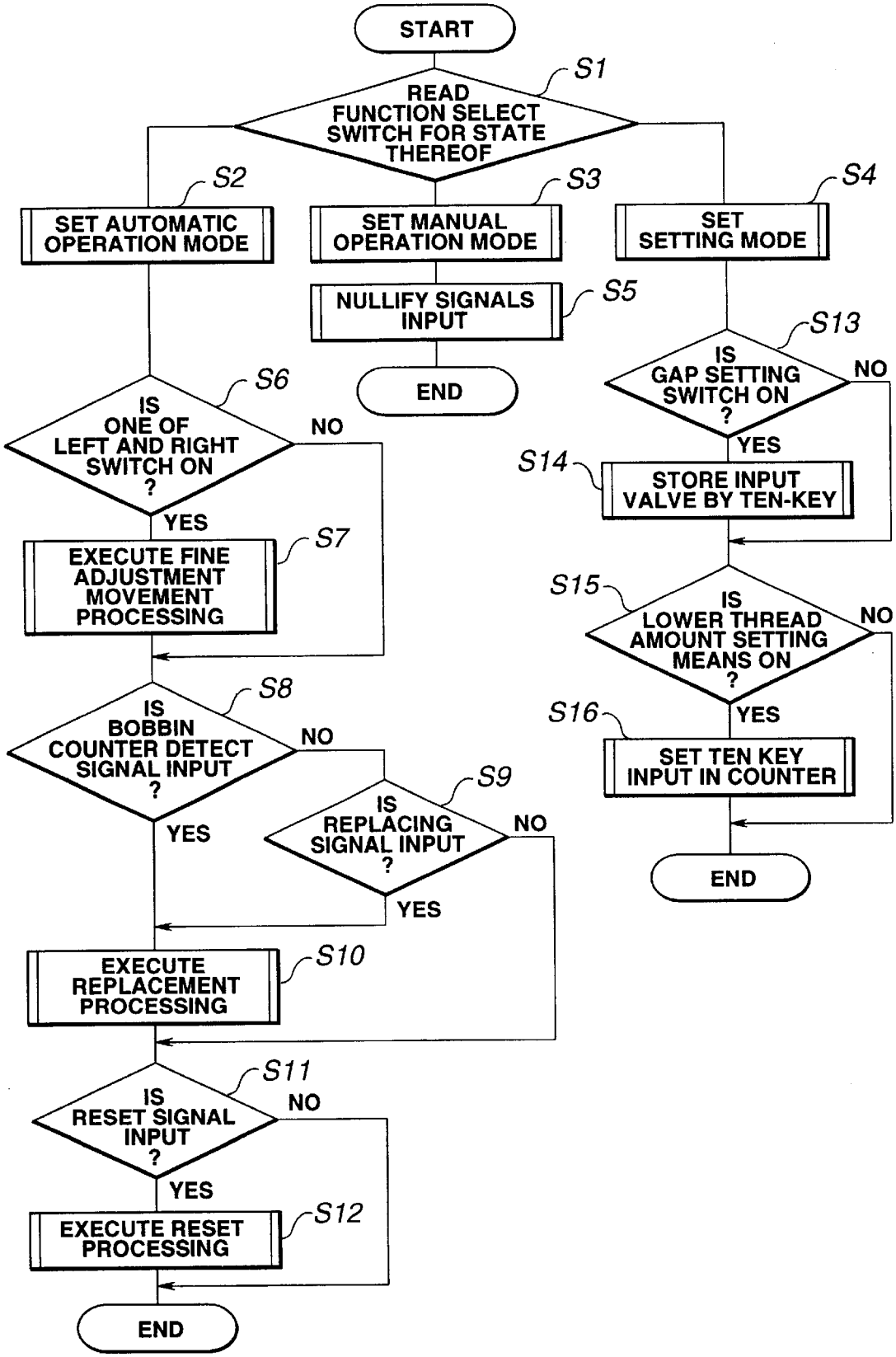
FIG. 10 is a flow chart for controlling the operation of the above embodiment according to the invention; and, FIG. 11 is a flow chart of a fine adjustment movement processing employed in the above embodiment according to the invention.

Now, referring to a flow chart shown in FIG. 10, the state of the function select switch 60 is judged (Step S1). In accordance with the state of the function select switch 60, the automatic operation mode, manual operation mode or setting mode is set (S2–S4).

If the manual operation mode is set, then signals, that is, the output signals of the right or left direction switches 60R and 60L, bobbin counter detect signal, reset signal, gap setting switch output signal and the like are nullified (S5).

Figure 11:
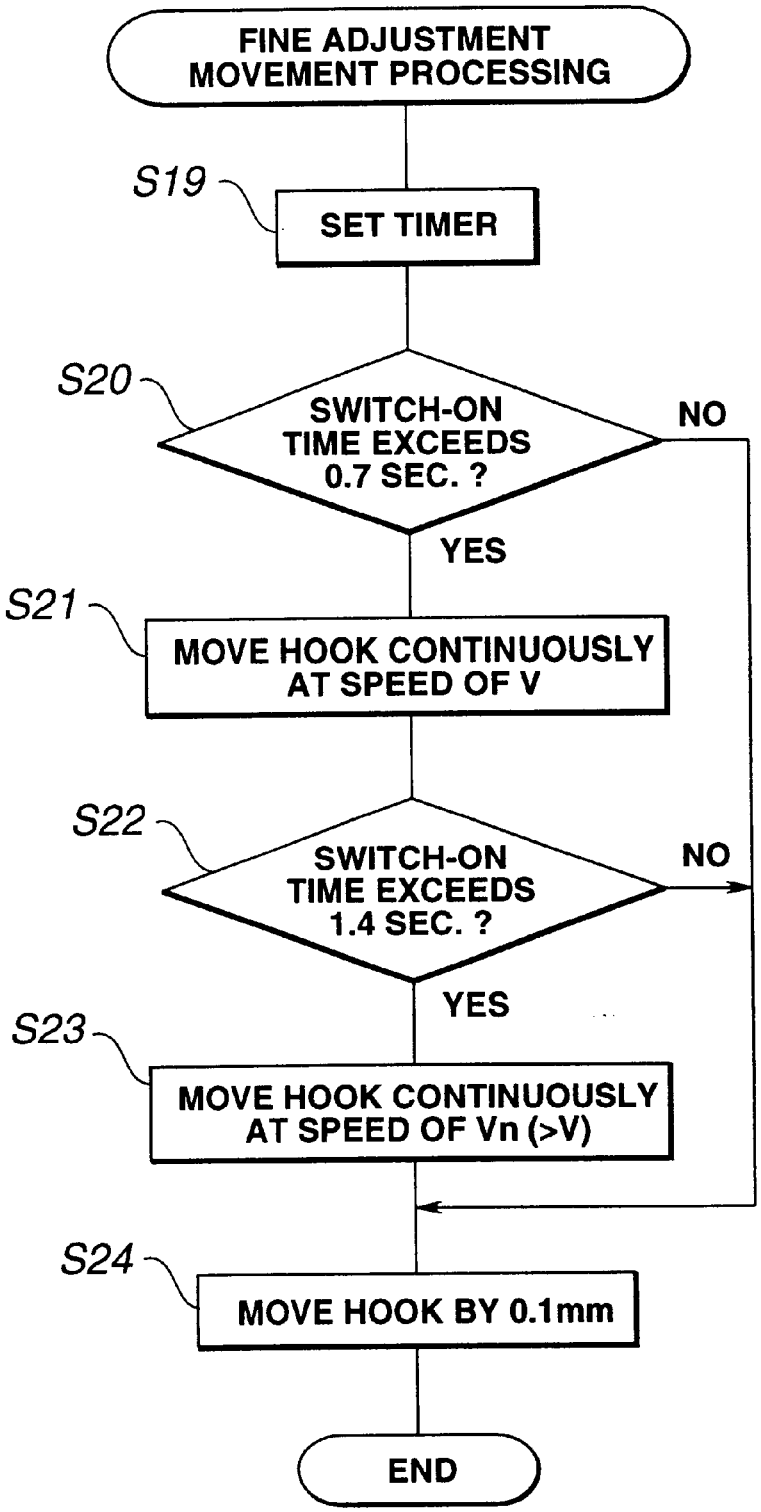

If the automatic operation mode is set, then it is checked whether one of the right and left direction switches 60R and 60L is switched on (S6) or not. If one of them is switched on, a fine adjustment movement processing routine (FIG. 11) is executed (S7). And, it is checked whether the bobbin counter detect signal is input or not (S8). If the bobbin counter detect signal is not input, then it is checked whether the bobbin replacing signal is input due to the operation of the bobbin replacing switch 54 or not (S9). If the bobbin counter detect signal or bobbin replacing signal is input, then the bobbin replacing processing is executed (S10). In the bobbin replacing processing, as described before, the pulse motor 36 is controlled in such a manner that the second vertical hook 27*b* is moved and separated further by 100 mm from the first vertical hook 27*a*.

Next, it is checked whether the reset signal is input or not (S11) and, if the reset signal is input, then the reset processing is executed (S12). In the reset processing, as described before, in order that the two vertical hooks 27*a* and 27*b* can provide a gap corresponding to the gap between the needles 7 and 7, there is read out the previously stored needle gap data, and the pulse motor 36 is controlled in such a manner that the second vertical hook 27*b* is moved to a position where the two vertical hooks 27*a* and 27*b* provide a gap corresponding to the present needle gap (length).

Referring further to the above-mentioned fine adjustment movement processing (FIG. 11), if the right direction switch 60R or left direction switch 60L is turned on, then the built-in timer of the control part 50 is set (S19) to thereby check whether the on time of the right direction switch 60R or left direction switch 60L exceeds 0.7 seconds or not (S20). And, if the on time exceeds 0.7 seconds, then the pulse motor 36 is controlled in such a manner that the second vertical hook 27*b* can be moved continuously at a speed of V in the right or left direction (S21).

Then, it is checked whether the on time of the right direction switch 60R or left direction switch 60L exceeds further 0.7 seconds or not, that is, whether the on time exceeds 1.4 seconds when measured from the very beginning of the switching operation (S22) or not, and, if the on time exceeds 1.4 seconds, then the pulse motor 36 is controlled in such a manner that the second vertical hook 27*b* can be moved continuously at a speed of $V_h$ faster than the speed of V in the same direction as the above-mentioned direction (S23).

If the on time of the right direction switch 60R or left direction switch 60L does not reach 0.7 seconds and thus the present switch is switched off, then the pulse motor 36 is controlled in such a manner that the second vertical hook 27*b* can be moved by 0.1 mm in the right or left direction (S24).

Now, if the setting mode is set, then it is checked whether the gap setting switch 59 is turned on or not (S13) and, if it is turned on, then there is executed a processing in which an input value is stored by the ten key 63 (S14); and, it is checked whether the lower thread winding amount setting means is turned on or not (S15) and, if it is found on, then the input value of the ten key 63 is set in the bobbin counter 56 (S16).

In the above-mentioned automatic operation mode, if the right direction switch 60R or left direction switch 60L is operated, then the control part 50 actuates the motor drive circuit 65 to thereby control the pulse motor 36 in such a manner that the second vertical hook 27*b* is moved, for example, by 0.1 mm in one of the right and left directions each time the right direction switch 60R or left direction switch 60L is operated once. Due to this, the gap between the two hooks can be adjusted finely.

By the way, in the above description, the unit gap of the fine adjustment is set for 0.1 mm. However, in more particular, it is determined in accordance with the resolving power of the pulse motor 36 or the resolving power of the position adjustment of the needles.

Next, description will be given below of the operation of the present embodiment having the above-mentioned structure.

In the belt loop sewing machine according to the present embodiment, in order to set the belt loop sewing gap in a desired gap, as a needle stopper for the needle rod 8 to be supported by the needle rod drive means 21, a needle stopper in which the two needles thereof provide a desired needle gap between them is selected and the corresponding needle rod 8 is mounted on the needle rod drive means 21.

And, in order that the gap between the first and second vertical hooks 27*a* and 27*b* can be set in such a manner as to correspond to the gap between the two needles 7, there are previously stored, in the memory of the control part 50, the needle gaps of two or more kinds of needle stoppers which are different from one another and are used very frequently. Therefore, if a number corresponding to the needle stopper to be used is selected and called from the memory of the control part 50, then the desired needle gap can be set with no need to input the needle gap each time. Accordingly, by operating the function select switch 60 of the operation panel 55, there is set a state capable of selecting the number corresponding to the needle stopper being currently used and, using the ten key, the number corresponding to the needle stopper being currently used is input. As a result of this, the data on the hook gap corresponding to the present needle gap is read out from the memory of the control part 50 and is then input to the control part 50. On receiving the present data, the control part 50 sends a drive pulse to the pulse motor 36 to thereby drive the pulse motor 36 so that the gap between the first and second vertical hooks 27*a* and 27*b* can be made to correspond to the gap between the two needles 7. By the way, when there is not present the number corresponding to the needle stopper being currently used, by operating the function select switch 60 of the operation panel 55, there is set a mode for adjusting the hook gap by band; and, by operating the two right and left direction switches 60R and 60L, a drive pulse is given to the pulse motor 36 to thereby drive the pulse motor 36 in such a manner that the gap between the first and second vertical hooks 27*a* and 27*b* can be made to correspond to the gap between the two needles 7.

By the way, referring in more particular to the driving operation of the pulse motor 36, the pulse motor 36 is driven once in such a manner that the second vertical hook 27*b* is moved up to the original point position where the light sensor 52 of the original point sensor 51 can detect the actuator 53 and, after then, the pulse motor 36 is further driven so that the second vertical hook 27*b* can be moved from the original point position up to the setting position thereof. The reason why the second vertical hook 27*b* is moved to the setting position thereof through the original point position thereof is to position the second vertical hook 27*b* accurately according to the number of pulses for driving the pulse motor 36. Next, the two right and left direction switches 60R and 60L are operated to thereby adjust the hook gap finely and, on completion of the fine adjustment, the function select switch 60 is operated to thereby complete the adjustment of the hook gap.

If the gap between the first and second vertical hooks 27*a* and 27*b* is set for a gap corresponding to the gap between the two needles 7 supported by the needle rod 8 in this manner, then the main portion of the sewing is set on an XY table which is provided on the sewing machine bed 5. In response to this, there is set a preparation completion state for sewing of the belt loop, so that the belt loop is delivered onto the sewing main portion by a fork mechanism (not shown). At the then time, if a sewing start switch is operated, then there can be carried out a given sewing operation to sew the belt loop to the sewing main portion.

While the above-mentioned sewing operation is being executed, when the kind of the lower thread in the two vertical hooks 27*a* and 27*b* are to be changed because the kind of the sewing is different, the bobbing replacing switch 54 may be operated. As a result of this, a bobbin replacing signal is output from the bobbin replacing switch 54 to the control part 50 and, on inputting the bobbin replacing signal therein, the control part 50 applies a drive signal to the pulse motor 36 to thereby drive the same in such a manner that the second vertical hook 27*b* can be separated further from the first vertical hook 27*a*. In response to this, the output shaft 36*a* of the pulse motor 36 is rotated together with the worm 37 fitted with the output shaft 36*a*, thereby rotating the worm gear 38 in meshing engagement with the worm 37. Due to the rotation of the worm gear 38, the pinion 40 fitted with the rotary shaft 39 supporting the worm gear 38 is rotated to thereby cause the rack 41 in meshing engagement with the pinion 40 to travel, so that the movable casing 31 together with the moving base 34 supporting the rack 41 is moved in such a manner as to part away from the end portion of the sewing machine bed 5. As a result of this, the second vertical hook 27*b* disposed within the movable casing 31 is separated further from the first vertical hook 27*a*. By the way, such separating movement is stopped at the time when a limit switch (not shown) for detecting the maximum separation position detects the movable casing 31. That is, when either of bobbins (not shown) in the first and second vertical hooks 27*a* and 27*b* is to be replaced, since the gap between the two vertical hooks 27*a* and 27*b* is now extended, the bobbin can be replaced easily. And, on completion of the bobbin replacement operation, if the reset switch 58 on the operation panel 55 is pressed down, then a rest signal is output from the reset switch 58 to the control part 50 and, in response to this, the control part 50 gives a drive pulse to the pulse motor 36 to thereby drive the same in such a manner that the second vertical hook 27*b* can be so moved as to approach the first vertical hook 27*a*. As a result of this, the output shaft 36*a* of the pulse motor 36 is rotated together with the worm 37 in the opposite direction to the direction where the second vertical hook 27*b* is separated away from the first vertical hook 27*a*, thereby rotating the worm gear 38 in meshing engagement with the worm 37 in the opposite direction. Due to the rotation of the worm gear 38 in the opposite direction, the pinion 40 fitted with the rotary shaft 39 supporting the worm gear 38 is rotated in the opposite direction to thereby cause the rack 41 in meshing engagement with the pinion 40 to travel in the opposite direction, so that the movable casing 31 together with the moving base 34 supporting the rack 41 is moved in such a manner as to approach the end portion of the sewing machine bed 5. As a result of this, the second vertical hook 27*b* disposed within the movable casing 31 is made to approach the first vertical hook 27*a*. By the way, the number of drive pulses to be given to the pulse motor 36 in order to make the second vertical hook 27*b* to approach the first vertical hook 27*a* is set equal to the number of drive pulses that were given to the pulse motor 36 when the second vertical book 27*b* was separated from the first vertical hook 27*a*.

Further, also when the count of the bobbin counter 56 set in the sewing operation becomes 0, the bobbin counter 56 outputs a bobbin replacing signal to the control part 40 and thus the control part 50 applies a drive pulse to the pulse motor 36 to thereby drive the same in such a manner the second vertical hook 27*b* can be made to part away from the first vertical hook 27*a*; that is, in this case as well, the bobbin can be replaced in a simple manner. By the way, alternatively, well-known lower thread residual amount detect means may be provided: that is, when the lower thread residual amount detect detects that the lower thread is used up and no lower thread is left, the gap between the two hooks 27*a* and 27*b* may be widened.

As described above, according to the belt loop sewing machine according to the embodiment of the invention, the gap between the two vertical hooks 27*a* and 27*b* can be set by driving the pulse motor 36 which can be driven using a pulse, the gap between the two vertical hooks 27*a* and 27*b* can be set simply and accurately.

Also, because the worm 37 is fitted with the output shaft 36*a* of the pulse motor 36 for moving the second vertical hook 27*b* which is a movable hook, and also because the movable casing 31 including the second vertical hook 27*b* is moved through the worm gear 38 in meshing engagement with the worm 37, even if a load is applied to the second vertical port 27*b*, the transmission of a torque causing the pulse motor 36 to rotate is cut off in the worm mechanism consisting of the worm 37 and worm gear 38; that is, even if a load is applied to the second vertical port 27*b*, there is no possibility that the second vertical hook 27*b* can be moved. Thanks to this, the two vertical hooks 27*a* and 27*b* are always able to maintain a set gap between them in a stable manner. Also, more preferably, the second vertical hook 27*b* may be structured in such a manner that it can be fixed to the hook support base 32 after completion of the hook gap adjustment.

Further, since there is provided the original point sensor 51 for setting the original point position of the second vertical hook 27*b* which is a movable hook, and also since the original point position of the second vertical hook 27*b* can be detected by use of the original point sensor 51, the control part 50 is able to control the setting position of the second vertical hook 27*b* in accordance with the number of pulses of the pulse motor 36 obtained from the original point position thereof, that is, the second vertical hook 27*b* can be positioned with high accuracy.

Still further, due to provision of the bobbin replacing switch 54 which outputs to the control part 50 a signal for replenishing the lower thread of at least one of the two vertical hooks 27*a* and 27*b* to thereby be able to widen the gap between the two vertical hooks 27*a* and 27*b*, when replenishing the lower thread of at least one of the two vertical hooks 27*a* and 27*b*, for example, when the lower thread is used up and no lower thread is left:, or when the kind of the lower thread must be changed, if the bobbin replacing switch 54 is operated, then the second vertical hook 27*b* which is a movable hook can be moved by the control part 50 in such a manner that it is separated further away from the first vertical hook 27*a*. Thanks to this, a space necessary for replacement of the bobbins can be secured and thus the bobbin replacement can be achieved with ease.

Yet further, as described before, since the belt loop supply means is disposed on one side of the sewing machine bed 5 and the pulse motor 36 is disposed on the other side or downwardly of the sewing machine bed 5, it is possible to secure a sufficient operation space for setting the main portion of the sewing as well as a sufficient space for installing the belt loop supply means.

By the way, the present invention is not limited to the above-mentioned embodiment but various changes and modifications are also possible. For example, in the foregoing description of the illustrated embodiment, there are used the vertical hooks but, according to the invention, it is also possible to use horizontal hooks. Also, it is also possible to employ a structure in which both of the two hooks can be moved. Further, the two-needle sewing machine is not limited to the belt loop sewing machine which has been described in the illustrated embodiment, but the two-needle sewing machine according to the invention can also apply to other various kinds of two-needle sewing machines.

As has been described heretofore, the two-needle sewing machine according to the invention comprises the two hooks which are disposed in such a manner as to correspond to the two needles, hook gap adjusting means for changing the gap between the two hooks, drive means for driving the hook gap adjusting means, transmission means for transmitting the driving of the driving means to the hook gap adjusting means, and control means for controlling the driving of the drive means to thereby control the hook gap. Due to use of this structure, while controlling the drive means by the control means, the drive means can drive the hook gap adjusting means to thereby adjust the gap between the two hooks automatically. That is, since there is no need to move the hook by hand, the gap between the two hooks can be adjusted easily.

Also, because one of the two hooks is fixed and the other hook is structured in such a manner as to be movable in approaching and parting directions with respect to one hook, there is eliminated the need for dual provision of the hook gap adjusting means, drive means and transmission means. This can not only provide a compact structure but also reduce the cost of the two-needle sewing machine.

Further, since the control means includes fine amount adjusting means for moving at least one of the two hooks by a slight amount, the gap between the two needles and the tip ends of the hooks can also be adjusted properly, that is, not manually but automatically.

Still further, because the two hooks are respectively vertical hooks in which the respective bobbins of the two vertical hooks are arranged opposed to each other, and also because of provision of the widening means for widening the gap between the two hooks by a given amount, the gap between the two hooks can be widened automatically by a given amount, which can facilitate not only the maintenance of the present two-needle sewing machine such as the cleaning of the peripheries of the hooks but also the replacing operation of the bobbins.

Also, since the widening means includes the bobbin replacing switch which can be operated when replacing the bobbins and the widening means can widen the gap between the two hooks by a give amount by means of the operation of the bobbin replacing switch, when replacing the bobbin, simply by operating the bobbin replacing switch, the gap between the two hooks can be widened by a given amount, which can facilitate the replacement of the bobbin.

Further, due to the fact that the widening means includes the bobbin replacement timing detect means for detecting the timing of the bobbin replacement of the two hooks and the widening means can widen the gap between the two hooks by a given amount by means of the output of the bobbin replacement timing detect means, the gap between the two hooks can be widened automatically by a given amount at the bobbin replacement timing, which makes it possible to reduce the burden of the operator in the bobbin replacing operation.

Still further, due to provision of the return control means for returning the movable hook held at its gap widened position back to its original position, even if the gap between the two hooks is separated further by a given amount in the maintenance of the present two-needle sewing machine or in the bobbin replacing operation, the gap between the two hooks can be returned to its original state easily, which eliminates the need to adjust the hook gap again.

And, since the hook gap adjusting means is structured such that it can be driven by hand as well, and also since there is provided the switch means which can switch the driving of the hook gap adjusting means by the drive means and the driving of the hook gap adjusting means by hand over to each other, even if the drive means cannot be used, the gap between the two hooks can be adjusted by hand.

Also, because the transmission means for transmitting the driving of the drive means to the hook gap adjusting means consists of the worm gear mechanism, the movable hook is prevented against movement after the hook gap is adjusted, which makes it possible to hold the set hook gap in a stable manner.

Further, owing to provision of the original point sensor for detecting the original point position of the movable hook, the movable hook can be positioned with accuracy.

And, since the drive means consists of the pulse motor, the drive means can be controlled easily and is inexpensive.

Also, because the present two-needle sewing machine includes the supply means for supplying the belt loop having an arbitrary width to the sewing position of the sewing, and also because the present sewing machine is a sewing machine which sews the belt loop to the sewing, there is eliminated the need to adjust the hook gap by hand, which not only avoids the need to secure a space for manual adjustment in the peripheries of the hooks but also can reduce the limit to the installation of the belt loop supply means.

Further, since the supply means is disposed on one side of the sewing machine bed and the drive means is disposed on the other side or downwardly of the sewing machine bed, it is possible to secure a sufficient operation space for setting the main portion of the sewing as well as a sufficient installation space for the supply means.

What is claimed is:

1. A sewing machine comprising:

an upper shaft having an axial direction;

two needles arranged in parallel to each other in said axial direction of said upper shaft, wherein said two needles are movable in a vertical direction to be synchronized with said upper shaft, and are possible to change a gap between themselves;

two hooks, each positioned on locus of the vertical movement of said respective needle;

two lower shafts including:

each of said lower shafts having a leading end to which one of said two hooks is fixed, wherein each of said lower shafts is disposed in parallel to said upper shaft to rotate synchronizing with said upper shaft; and the other of said lower shafts having a leading end to which the other of said two hooks is fixed, wherein said other of said lower shafts is disposed in parallel to said upper shaft to rotate such that said other of said lower shafts interlocks with said upper shaft;

a link member linking between said lower shafts to synchronize rotations of said lower shafts;

hook gap adjusting means for moving at least one of said lower shafts in said axial direction to change a gap between said two hooks;

driving means, being electrically driven, for driving said hook gap adjusting means;

control means for controlling said driving means such that said two hooks have a distance to each other corresponding to a distance between said two needles.

2. The sewing machine according to claim 1, wherein one of said two hooks is disposed within a bed of said sewing machine, the other of said two hooks is disposed within a movable casing, and said driving means drives said movable casing.

3. The machine as set forth in claim 1, further including an original point sensor for detecting the original point position of said movable hook.

4. In a sewing machine comprising: two needles being possible to change a gap in-between; needle rod drive means for moving said two needles in a vertical direction; two hooks respectively disposed so as to correspond to said two needles; hook gap adjusting means for changing a gap between said two hooks, the improvement which comprises:

drive means for driving said hook gap adjusting means;

transmission means for transmitting the driving of said drive means to said hook gap adjusting means;

control means for controlling the driving of said drive means to thereby control said hook gap; and wherein said two hooks are vertical hooks which are respectively located such that bobbins within said two hooks are disposed opposed to each other, and also wherein there is provided widening means for widening the gap between said two hooks by a given amount, wherein said widening means includes a bobbin replacing switch which is operative when replacing said bobbins, and, the operation of said bobbin replacing switch, said widening means widens the gap between said two hooks by a given amount.

5. In a sewing machine comprising: two needles being possible to change a gap in-between; needle rod drive means for moving said two needles in a vertical direction; two hooks respectively disposed so as to correspond to said two needles; hook gap adjusting means for changing a gap between said two hooks, the improvement which comprises:

drive means for driving said hook gap adjusting means;

transmission means for transmitting the driving of said drive means to said hook gap adjusting means;

control means for controlling the driving of said drive means to thereby control said hook gap; and wherein said two hooks are vertical hooks which are respectively located such that bobbins within said two hooks are disposed opposed to each other, and also wherein there is provided widening means for widening the gap between said two hooks by a given amount, wherein said widening means includes bobbin replacement timing detect means for detecting the timing for replacing said bobbins within said two hooks and, in accordance with the output of said bobbin replacement timing detect means, said widening means can widen the gap between said two hooks by a given amount.

6. In a sewing machine comprising: two needles being possible to change a gap in-between; needle rod drive means for moving said two needles in a vertical direction; two hooks respectively disposed so as to correspond to said two needles; hook gap adjusting means for changing a gap between said two hooks, the improvement which comprises:

drive means for driving said hook gap adjusting means;

transmission means for transmitting the driving of said drive means to said hook gap adjusting means;

control means for controlling the driving of said drive means to thereby control said hook gap;

wherein said two hooks are vertical hooks which are respectively located such that bobbins within said two hooks are disposed opposed to each other, and also wherein there is provided widening means for widening the gap between said two hooks by a given amount;

return control means for returning a movable hook held at its gap widened position back to its original position.

7. The sewing machine as set forth in claim 6, further including an original point sensor for detecting the original point position of said movable hook.

8. In a sewing machine comprising: two needles being possible to change a gap in-between; needle rod drive means for moving said two needles in a vertical direction; two hooks respectively disposed so as to correspond to said two needles; hook gap adjusting means for changing a gap between said two hooks, the improvement which comprises:

drive means for driving said hook gap adjusting means;

transmission means for transmitting the driving of said drive means to said hook gap adjusting means;

control means for controlling the driving of said drive means to thereby control said hook gap; and wherein said hook gap adjusting means is structured such that it can be driven by hand, and also wherein there is provided switch means which can switch the driving of said hook gap adjusting means by said drive means and the driving of said hook gap adjusting means by hand over to each other.

9. The sewing machine as set forth in claim 8, further including an original point sensor for detecting the original point position of said movable hook.

10. A sewing machine comprising:

an upper shaft having an axial direction;

two needles arranged in parallel to each other in said axial direction of said upper shaft, wherein said two needles are movable in a vertical direction to be synchronized with said upper shaft, and are possible to change a gap between themselves;

two hooks, each positioned on locus of the vertical movement of said respective needle;

two lower shafts including:

each of said lower shafts having a leading end to which one of said two hooks is fixed, wherein each of said lower shafts is disposed in parallel to said upper shaft to rotate synchronizing with said upper shaft; and the other of said lower shafts having a leading end to which the other of said two hooks is fixed, wherein said other of said lower shafts is disposed in parallel to said upper shaft to rotate such that said other of said lower shafts interlocks with said upper shaft;

a link member linking between said lower shafts to synchronize rotations of said lower shafts;

hook gap adjusting means for moving at least one of said lower shafts in said axial direction to change a gap between said two hooks;

driving means, being electrically driven, for driving said hook gap adjusting means;

control means for controlling said driving means such that said two hooks have a distance to each other corresponding to a distance between said two needles;

a manual switch, wherein said driving means is operative by a small amount when said manual switch is operated.

11. A sewing machine comprising:

an upper shaft having an axial direction;

two needles arranged in parallel to each other in said axial direction of said upper shaft, wherein said two needles are movable in a vertical direction to be synchronized with said upper shaft, and are possible to change a gap between themselves;

two hooks, each position on locus of the vertical movement of said respective needle;

two lower shafts, including:

each of said lower shafts having a leading end to which one of said two hooks is fixed, wherein said each of said lower shafts is disposed in parallel to said upper shaft to rotate synchronizing with said upper shaft; and the other of said lower shafts having a leading end to which the other of said two hooks is fixed, wherein said other of said lower shafts is disposed in parallel to said upper shaft to rotate such that said other of said lower shafts interlocks with said upper shaft;

a link member linking between said lower shafts to synchronize rotations of said lower shafts;

hook gap adjusting means for moving at least one of said lower shafts in said axial direction to change a gap between said two hooks;

driving means, being electrically driven, for driving said hook gap adjusting means;

control means for controlling said driving means such that said two hooks have either a first distance to each other corresponding to a distance between said two needles or a second distance with is longer than said first distance.

12. The sewing machine according to claim 11, said control means includes switch means for generating plural signals, each corresponding to said respective distance.

13. The sewing machine according to claim 11, wherein said link member includes two linking shafts which enable to transmit a rotational force at a designated displacement in the axial direction and also serves as said hook gap adjusting means.

14. The sewing machine according to claim 13, wherein one of said linking shafts has a spline and the other of said linking shafts has a spline cylinder to engage with said spline.

15. The sewing machine according to claim 11, wherein one of said two hooks is disposed within a bed of said sewing machine, the other of said two hooks is disposed within a movable casing, and said driving means drives said movable casing.

16. In a sewing machine comprising: two needles being possible to change a gap in-between; needle rod drive means for moving said two needles in a vertical direction; two hooks respectively disposed so as to correspond to said two needles; hook gap adjusting means for changing a gap between said two hooks, the improvement which comprises:

drive means for driving said hook gap adjusting means;

transmission means for transmitting the driving of said drive means to said hook gap adjusting means;

control means for controlling the driving of said drive means to thereby control said hook gap; and wherein said two hooks are vertical hooks which are respectively located such that bobbins within said two hooks are disposed opposed to each other, and also wherein there is provided widening means for widening the gap between said two hooks by a given amount, wherein said widening means includes a bobbin replacing switch which is operative when replacing said bobbins, and, the operation of said bobbin replacing switch, said widening means widens the gap between said two hooks by a given amount;

an original point sensor for detecting the original point position of said movable hook.

17. In a sewing machine comprising: two needles being possible to change a gap in-between; needle rod drive means for moving said two needles in a vertical direction; two hooks respectively disposed so as to correspond to said two needles; hook gap adjusting means for changing a gap between said two hooks, the improvement which comprises:

drive means for driving said hook gap adjusting means;

transmission means for transmitting the driving of said drive means to said hook gap adjusting means;

control means for controlling the driving of said drive means to thereby control said hook gap; and wherein said two hooks are vertical hooks which are respectively located such that bobbins within said two hooks are disposed opposed to each other, and also wherein there is provided widening means for widening the gap between said two hooks by a given amount, wherein said widening means includes bobbin replacement timing detect means for detecting the timing for replacing said bobbins within said two hooks and, in accordance with the output of said bobbin replacement timing detect means, said widening means can widen the gap between said two hooks by a given amount;

an original point sensor for detecting the original point position of said movable hook.

* * * * *